US005567169A

United States Patent [19]

McCleerey et al.

[11] Patent Number: 5,567,169

[45] Date of Patent: *Oct. 22, 1996

[54] ELECTROSTATIC DISCHARGE CONDUCTOR TO SHELL CONTINUITY

[75] Inventors: Earl W. McCleerey; George R. Defibaugh, both of Mechanicsburg, Pa.; Edward K. Marsh, Kernersville, N.C.; Richard A. Nelson, Glen Ellyn, Ill.; Gary J. Verdun, Houston, Tex.

[73] Assignees: The Whitaker Corporation, Wilmington, Del.; Compaq Computer Corporation, Houston, Tex.

[ * ] Notice: The term of this patent shall not extend beyond the expiration date of Pat. No. 5,567,168.

[21] Appl. No.: 977,800

[22] Filed: Nov. 17, 1992

(Under 37 CFR 1.47)

Related U.S. Application Data

[63] Continuation of Ser. No. 947,079, Sep. 17, 1992, abandoned, and a continuation-in-part of Ser. No. 836,155, Feb. 13, 1992, abandoned, which is a continuation of Ser. No. 658,135, Feb. 20, 1991, abandoned, said Ser. No. 947,079, Sep. 17, 1992, abandoned, is a continuation of Ser. No. 771,871, Oct. 1, 1991, abandoned, which is a continuation of Ser. No. 589,143, Sep. 27, 1990, abandoned.

[51] Int. Cl.[6] ..... H01R 13/53

[52] U.S. Cl. ..... 439/181; 439/607

[58] Field of Search ..... 439/108, 181, 439/186, 187, 607, 676

[56] References Cited

U.S. PATENT DOCUMENTS

| | | | |
|---|---|---|---|
| 3,148,929 | 9/1964 | Gordon | 339/176 |
| 3,395,377 | 7/1968 | Straus | 339/17 |
| 3,692,966 | 9/1972 | Lancaster | 200/51.1 |
| 3,760,335 | 9/1973 | Roberts | 339/99 R |
| 3,963,300 | 6/1976 | Patton et al. | 339/156 R |
| 4,179,178 | 12/1979 | Bachman et al. | 339/111 |
| 4,392,705 | 7/1983 | Andrews et al. | 339/75 MP |
| 4,418,972 | 12/1983 | Benasutti | 339/14 R |
| 4,456,800 | 6/1984 | Holland | 200/5 A |
| 4,458,291 | 7/1984 | Yanagisawa et al. | 361/212 |
| 4,477,134 | 10/1984 | Wright | 339/17 F |
| 4,531,176 | 7/1985 | Beecher, II | 361/424 |
| 4,532,419 | 7/1985 | Takeda | 235/492 |
| 4,568,133 | 2/1986 | Amano et al. | 339/14 R |
| 4,597,631 | 7/1986 | Flores | 350/96.2 |
| 4,673,236 | 6/1987 | Musolff et al. | 439/609 |
| 4,688,868 | 8/1987 | Noyes | 439/108 |
| 4,692,121 | 9/1987 | Arbogast, Jr. | 439/874 |
| 4,697,864 | 10/1987 | Hayes et al. | 439/444 |
| 4,699,438 | 10/1987 | Kikuta | 439/95 |
| 4,705,339 | 11/1987 | Hayes et al. | 439/277 |
| 4,711,506 | 12/1987 | Tanaka | 439/108 |
| 4,731,031 | 3/1988 | Lemke | 439/76 |
| 4,737,116 | 4/1988 | Slye et al. | 439/92 |
| 4,743,080 | 5/1988 | Siraty | 439/492 |
| 4,767,350 | 8/1988 | Cooper et al. | 439/271 |
| 4,773,878 | 9/1988 | Hansel, III | 439/497 |
| 4,806,109 | 2/1989 | Manabe et al. | 439/108 |
| 4,824,377 | 4/1989 | De Burro | 439/186 |
| 4,824,383 | 4/1989 | Lemke | 439/108 |
| 4,889,497 | 12/1989 | Riches | 439/76 |
| 4,889,502 | 12/1989 | Althouse et al. | 439/607 |
| 4,906,208 | 3/1990 | Nakamura et al. | 439/607 |
| 5,030,140 | 7/1991 | Sugiyama | 439/607 |
| 5,064,391 | 11/1991 | Buchter | 439/733 |
| 5,066,240 | 11/1991 | Verdun | 439/181 |
| 5,085,601 | 2/1992 | Buchter et al. | 439/660 |

OTHER PUBLICATIONS

AMP Drawing 747481 of a receptacle assembly, dated (approved) Apr. 25, 1984.

*Primary Examiner*—Gary F. Paumen
*Attorney, Agent, or Firm*—Brinks Hofer Gilson & Lione

[57] ABSTRACT

An electrostatic discharge conductor to shell continuity system is disclosed for an electrical connector. The connector (20, 120) has a dielectric housing (24) with a recess (68, 74) for receiving an electrostatic discharge conductor (70). The electrostatic discharge conductor (70) extends along a forward face of the housing (24) and extends into the recess. The portion of the electrostatic discharge conductor extending into the recess (74) engages a surface of an electrically conductive shell (44, 144) securable to the housing (24), thereby providing electrical continuity between the shell (44, 144) and the electrostatic discharge conductor (70).

17 Claims, 4 Drawing Sheets

ELECTROSTATIC DISCHARGE CONDUCTOR TO SHELL CONTINUITY

CROSS REFERENCE TO RELATED APPLICATIONS

This is a continuation of application Ser. No. 07/947,079, filed Sep. 17, 1992, by Earl W. McCleerey and George R. Defibaugh; and now abandoned which is a continuation of application Ser. No. 07/771,871, filed Oct. 1, 1991, and now abandoned; which is a continuation of application Ser. No. 07/589,143, filed Sep. 27, 1990, and now abandoned. This is also a continuation-in-part of application Ser. No. 07/836,155, filed Feb. 13, 1992, by Edward K. Marsh and Richard A. Nelson; and now abandoned which is a continuation of application Ser. No. 07/658,135, filed Feb. 20, 1991, and now abandoned.

BACKGROUND OF THE INVENTION

This invention relates to electrical connectors having an electrostatic discharge conductor, and in particular to providing electrical continuity between an electrostatic discharge conductor and a shell of an electrical connector.

Circuits to which contacts of electrical connectors are commoned are sensitive to or can be damaged by transient voltages such as electrostatic discharge. To prevent the electrostatic discharge from conducting to the circuits, it is prevented from discharging to the contacts of the connector. To prevent electrostatic buildup on a device being electrically connected to the electrical connector from discharging to one or more contacts of the connector, an electrostatic discharge conductor is typically positioned forward of the leading edge of the contacts in the connector to be the location to which an electrostatic discharge is grounded.

There is disclosed in U.S. Pat. No. 4,824,377 issued Apr. 25, 1987, to DeBurro an electrical connector incorporating an electrostatic discharge conductor. The conductor's position forward of the leading edge of the contacts in the connector is the location to which an electrostatic discharge is grounded.

It would be desirable to have an electrostatic discharge conductor to shell continuity system that would permit ease of assembly and be reliable in assuring an electrical and mechanical engagement between the electrostatic discharge conductor and the shell of a connector.

SUMMARY OF THE INVENTION

In accordance with the present invention, an electrical connector includes an electrostatic discharge conductor. The connector has a dielectric housing with a recess of predetermined depth. The electrostatic discharge conductor extends along a forward face of the housing and extends into the recess. The portion of the electrostatic discharge conductor extending into the recess has a cross-section dimension that is greater than the predetermined depth of the recess. An electrically conductive shell securable to the housing covers at least a portion of the recess and engages the first portion of the electrostatic discharge conductor such that the electrostatic discharge conductor and the shell are electrically common.

DESCRIPTION OF THE PREFERRED EMBODIMENT

Figure 1:
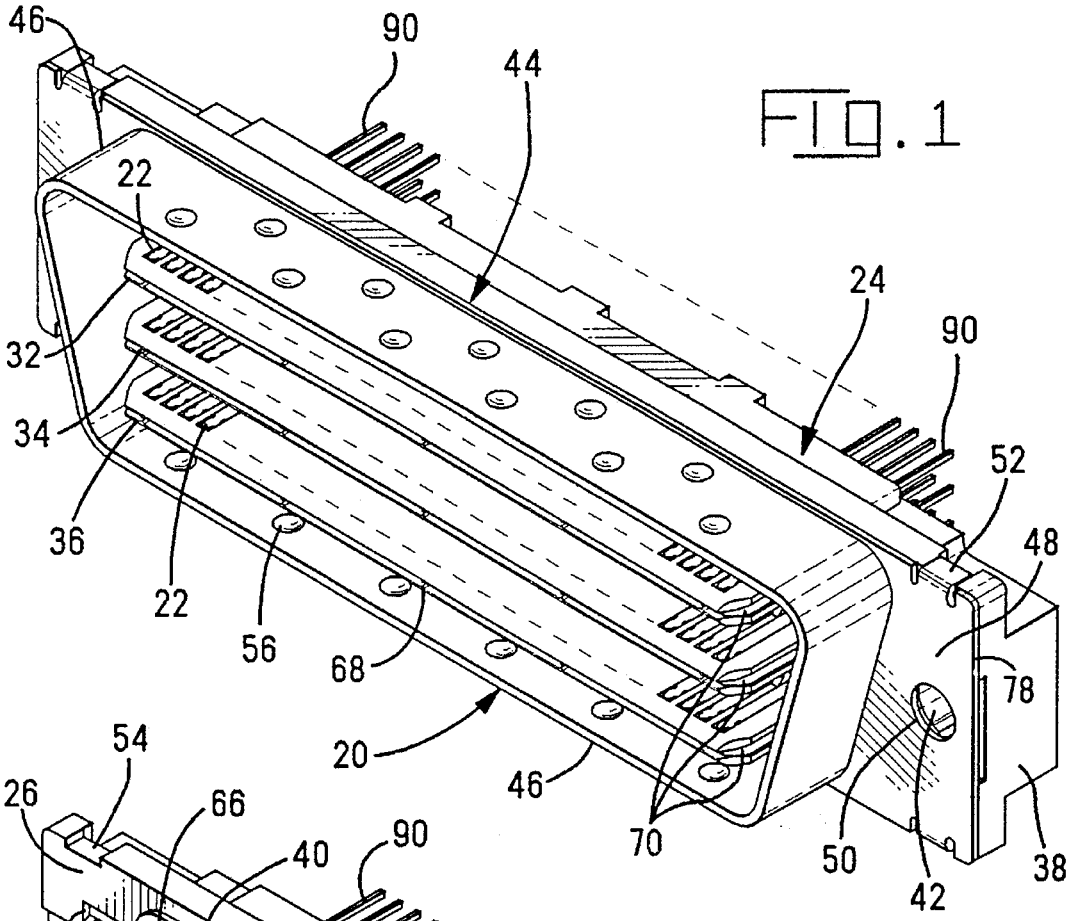
FIG. 1 is a perspective view of a plug connector with an electrostatic discharge conductor commoned with the shell in accordance with the present invention.
Figure 2:
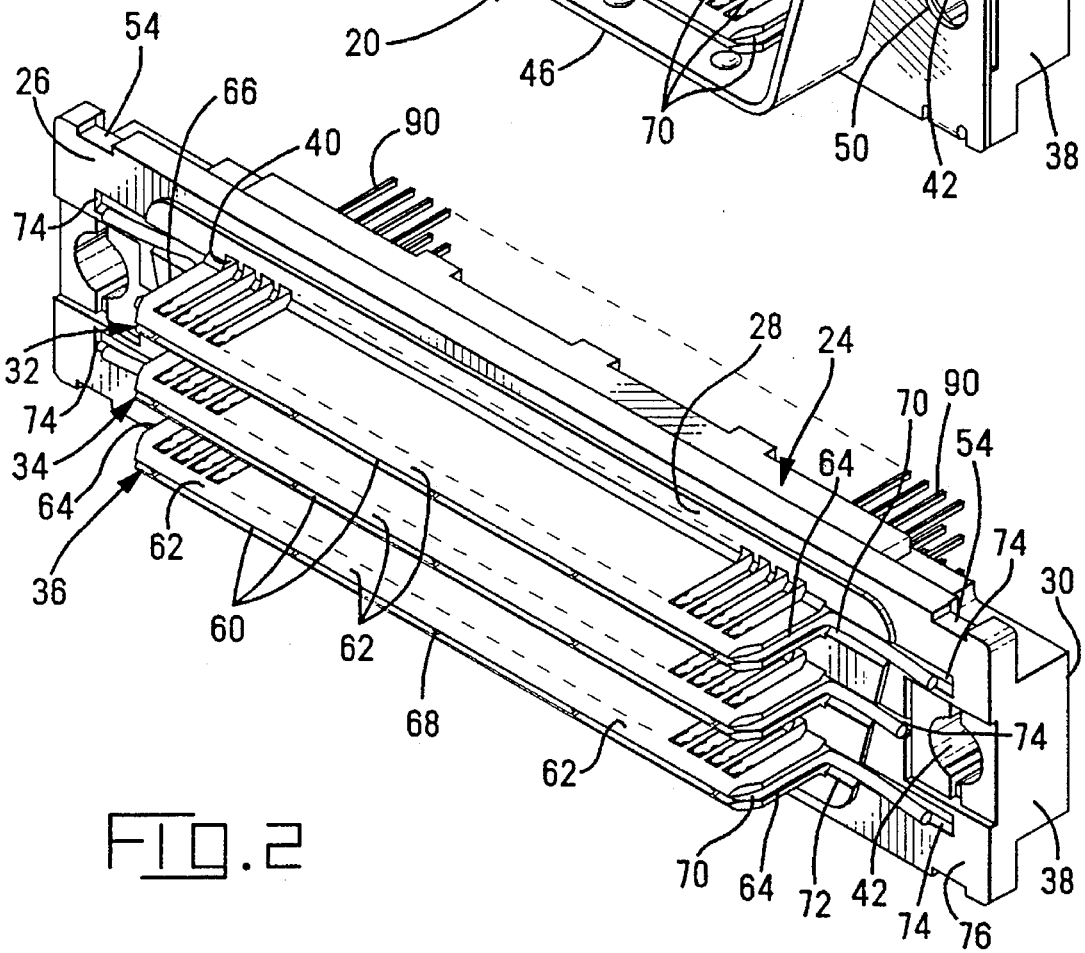
FIG. 2 is a perspective view of the dielectric housing of the connector of FIG. 1 after removal of the shell.
Figure 3:
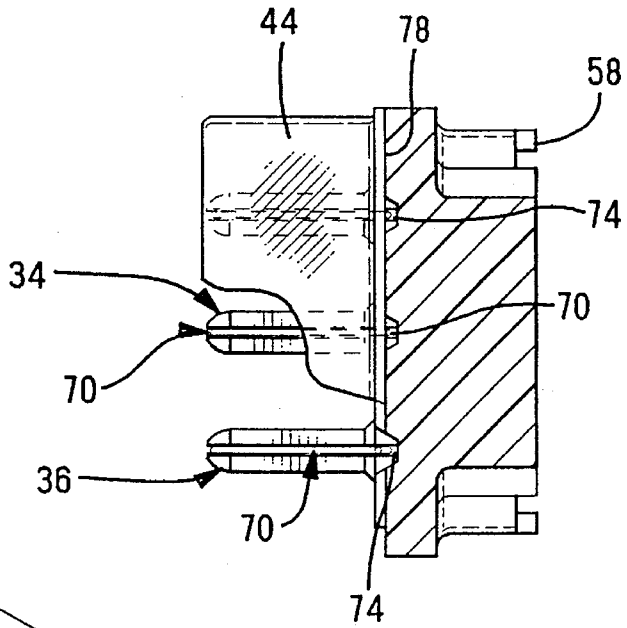
FIG. 3 is a partially sectioned end view of the connector of FIG. 1 with the shell partly cut away.
Figure 4:
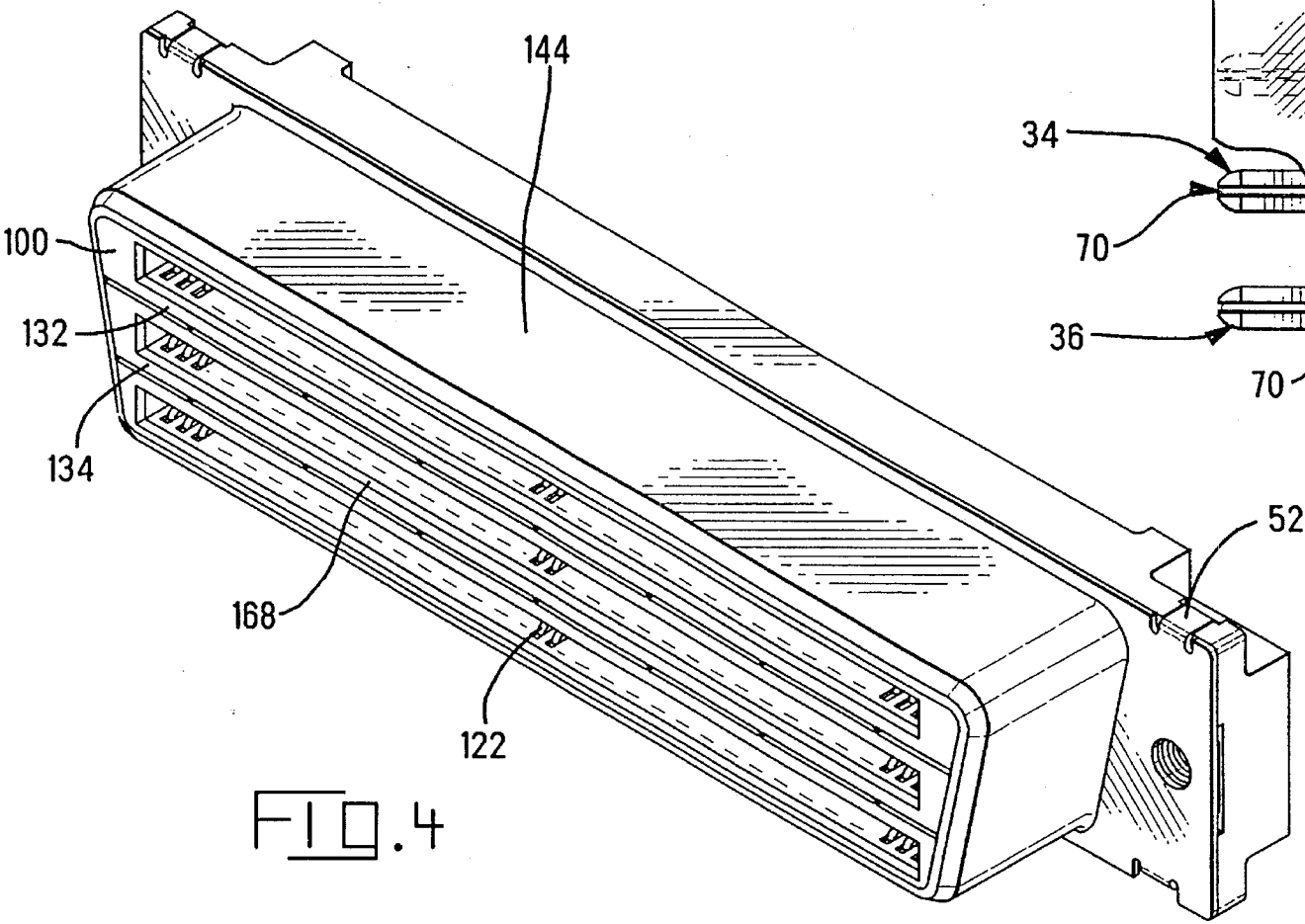
FIG. 4 is a perspective view of a receptacle connector with an electrostatic discharge conductor commoned with the shell in accordance with the present invention.
Figure 6:
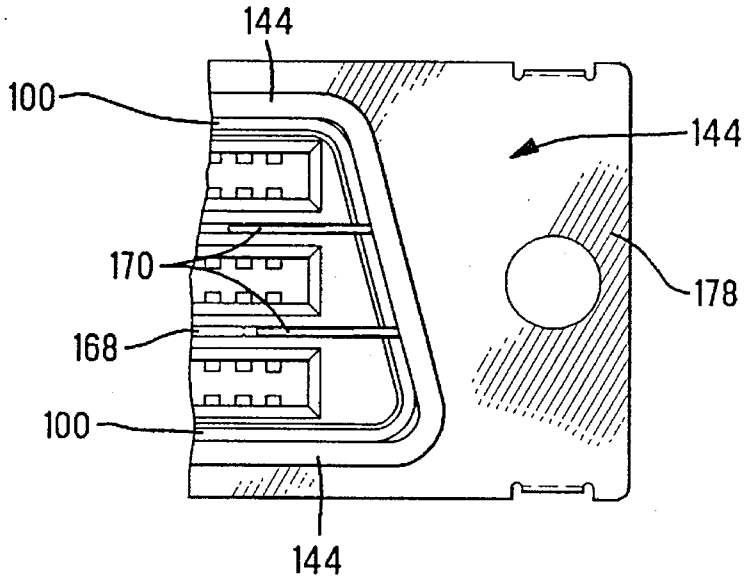
FIG. 6 is a partial front view of the receptacle connector of FIG. 4.
Figure 5:
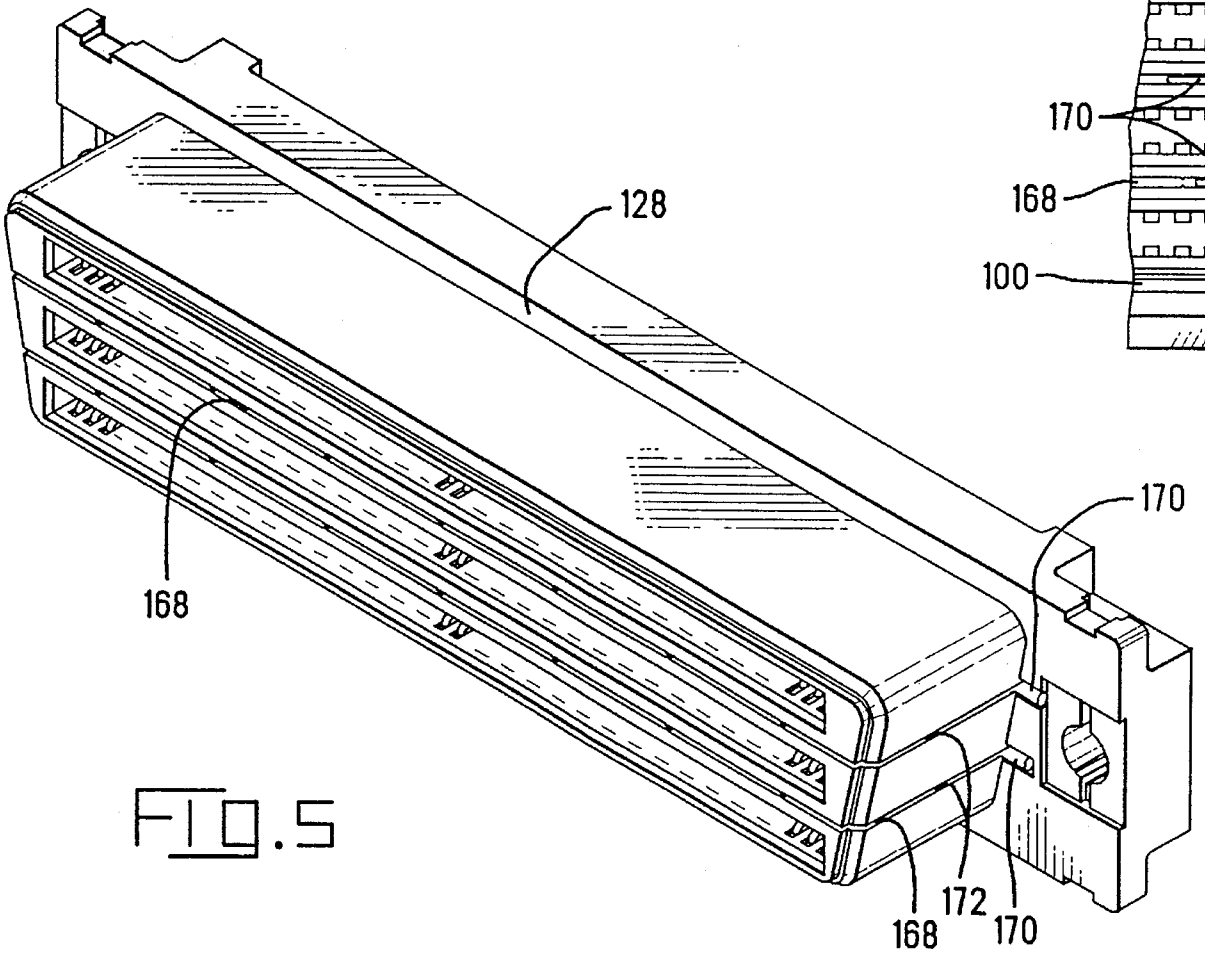
FIG. 5 is a perspective view of the dielectric housing of the connector of FIG. 4 after removal of the shell.
Figure 7:
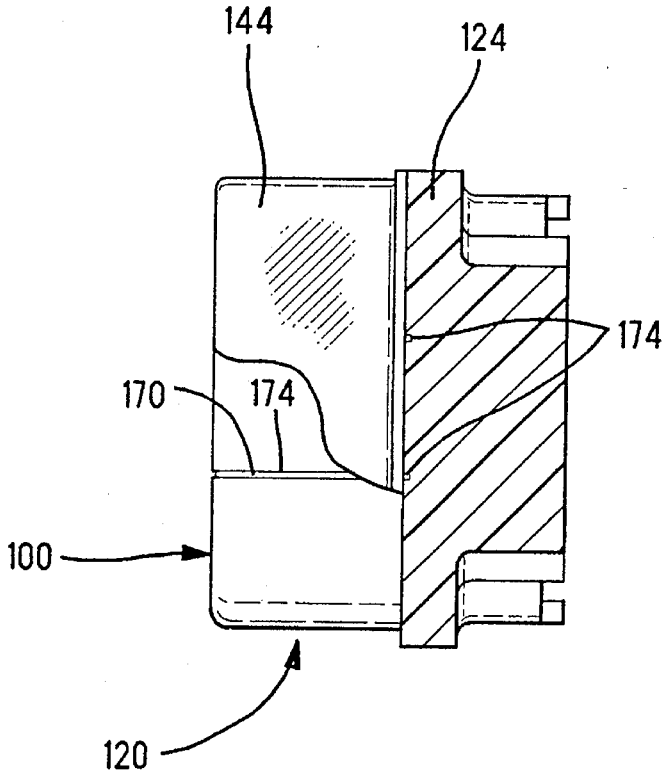
FIG. 7 is a partially sectioned end view of the connector of FIG. 5 with the shell partly cut away.

A perspective view of a connector 20 in the form of a board mount vertical header having an electrostatic discharge wire continuity system in accordance with the present invention is shown in FIGS. 1 through 3. Connector 20 includes insulative housing (or body portion formed from an insulative material) 24 molded of a suitable dielectric plastic material with integral peripheral flange 26, a mating side 28 and an opposed rear face 30. Contacts 22 are secured in housing 24. Three substantially identically spaced contact support fins or connector blades 32, 34 and 36 extend from mating side 28. Extending through block 38 between mating side 28 and rear face 30 are a plurality of contact receiving channels 40 for receiving and securing contacts 22 in housing 24. Flange 26 has mounting apertures 42 at opposite ends thereof for mounting or securing a complementary connector thereto.

Electrically conductive outer shell 44 has a subminiature D-shaped shroud 46 extending upwardly from mating side 28 and the flat portion 48 of shell 44. Shroud 46 provides a polarization feature to connector 20 and shields contacts 22 and fins 32, 34 and 36. The flat portion 48 of shell 44 has mounting apertures 50 aligned with apertures 42 and housing 24. Lugs 52 on the periphery of flat portion 48 folding to recesses 54 of housing 24 thereby securing shell 44 to housing 24. Shroud 46 may have inwardly directed resilient protrusions in the form of grounding indents 56 to assure sufficient electrical and mechanical engagement between shroud 46 and the shroud of a mated complementary connector. At least a portion of the periphery of rear face 30 provides a coplanar mounting face 58 (see FIG. 3) which is received against a circuit board when connector 20 is mounted thereon.

Each contact support fin 32, 34 and 36 has an electrostatic discharge grounding wire slot (groove) 60 recessed in distal (loading) edge 62. Slot 60 also extends along side edges sidewalls 64 and 66. Spaced at intervals along slot 60 are inwardly directed interference protrusions 68 to reduce the cross section of slot 60 to provide an interference fit with an electrostatic discharge wire (conductive material in the form of a strip) 70 received in slot 60 between a pair of protrusions 68 or between a protrusion 68 and the side wall of slot 60. The depth of slot 60 along distal edges 62 may be substantially the same as, less than or greater than the diameter of wire 70.

Wire 70, typically manufactured of stainless steel for strength and corrosion resistance, is bent substantially ninety degrees at the corner of fins 32, 34 and 36 where distal edge 62 intersects respective side edges 64 and 66. Wire 70 bends again proximate mating side 28 at the base 72 of fins 32, 34 and 36 to extend along mating side 28 outwardly away from the fins in respective electrostatic discharge channels or recesses 74 beyond respective side edges 64, 66 into flange 26. Electrostatic discharge channels 74 extend through the region of flanges 26. Wires 70 are typically installed in slots 60 prior to shell 44 being secured to housing 24.

Channels 74 may be less than, greater than or the same depth of a wire 70 to be received therein. One or more of several techniques could be employed to assure mechanical engagement between wire 70 and shell 44 and thus electrical continuity therebetween. Shell 44 could be deformed in the region of a channel to engage a wire 70. Where the depth of the channel is less than the diameter of the wire, or where no channel is present, the wire will be compressed or sandwiched between the shell and the housing upon assembly of the shell onto the housing during manufacture. Yet another technique is to bend wire 70 more than ninety degrees where wire 70 extends along side edges 64 and 66 and bends to extend along flanges 26. In this manner, the distal end of wire 70, in an unbiased position as shown in FIG. 2, extends outwardly from housing 24 and channel or recess 74 to a location above the plane of surface 76. Upon assembly of shell 44 onto housing 24 during manufacture, the distal ends of wires 70 engage the under or rear surface 78 of shell 44 and are biased inward toward housing 24 as shown in FIG. 3. This latter technique is desirable because it is tolerance forgiving. Yet another technique of spot welding wire 70 to shell 44 is described below.

A drop-in insert (not shown) in accordance with the teaching of U.S. Pat. No. 4,889,502, issued Dec. 26, 1989, to Althouse et al. the teaching of which is hereby incorporated by reference may be inserted into apertures 42 before shell 44 is secured to housing 24. Thus, upon installation of shell 44, wires 70 are secured to housing 24 of connector 20 typically with at least a portion of wire 70 extending above the surface 76 of flange 26 to engage the under or rear surface 78 of flat portion 48 of shell 44. In this manner, wires 70 make electrical and mechanical contact with shell 44. In this manner, wires 70 are biased or sandwiched between rear surface 78 and channel 74 of housing 24, assuring mechanical and electrical engagement between wire 70 and shell 44. Wires 70 are thus secured to connector 20 and electrically commoned to shell 44. Any electrostatic discharge discharged to wire 70 such as during mating with a complementary connector is carried to the same ground as that to which shell 44 is grounded.

Each of contacts 22 in connector 20 may be substantially identical. Contacts 22 are stamped and formed typically from phosphor bronze stock on the center line spacing they will be received in housing 24 and carried on a carrier strip to maintain the center line spacing until assembly. Contacts 22 are secured in housing 24 by barbs on the contacts engaging side walls of passages 40 through block 38. The solder tails (pin connectors) 90 may differ in length or formation to accommodate a particular footprint and may be plated as is known in the art.

A complementary connector 120 matable with connector 20, incorporating the electrostatic discharge conduct to shell continuity system in accordance with the present invention is shown in FIGS. 4 through 7. Connector 120 is very similar in structure to connector 20. Contacts 122 of connector 120 engage contacts 22 of connector 20 in use. Connector 120 has a dielectric shroud 100 upstanding from forward face or surface 128 forming a trapezoidal or subminiature D shape for polarization. Extending across the greater dimension of the shroud are interconnecting members 132, 134 which are received between pairs of fins 32, 34 and 36 when connectors 20 and 120 are mated. An electrostatic discharge conductor 170 extends along edge of members 132, 134 and may be secured in a channel 168. Channel 168 extends along the upstanding shroud providing a recess in which electrostatic discharge or conductor wire 170 is received. The depth of the recess along the distal edge of members 132, 134 may be less than, greater than or equal to the diameter of wire 170. Channels 168 extend along the vertical outer surface of shroud 100 providing side channels 172. The depth of channels 172 is less than the diameter of electrostatic discharge wire 170. Channels 168 also extend along surface 128 and may be less than the diameter of wire 170. In this manner, an electrostatic discharge wire 170 is positioned in channels 168 and subsequently a shell 144 is pressed over shroud 100 sandwiching electrostatic discharge wire 170 between shroud 100 and housing 124 in channels 168. This assures electrical and mechanical engagement between housing 124 and electrostatic discharge conductor 170 which in turn assures electrical continuity.

Figure 8:
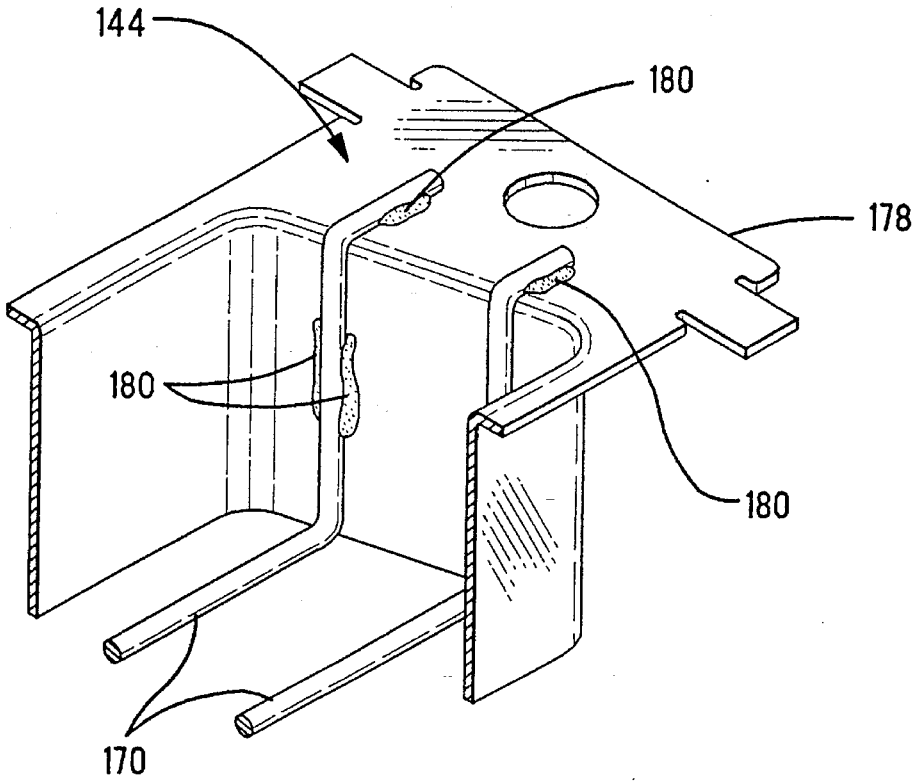
FIG. 8 is a partial perspective view of the inside of a shell showing an electrostatic discharge conductor spot welded thereto.

Alternatively, electrostatic discharge conductor 170 may be spot welded to shell 144 with welds 180 on the side of the body of shell 144, as well as on the flat portion 178 of shell 144, to make electrical and mechanical engagement. This subassembly, shown in a partial perspective view in FIG. 8, can be fabricated in a jig (not shown) to assure proper positioning of electrostatic discharge conductor 170 to be received in channels 168 in housing 124. With the subassembly of the shell and electrostatic discharge wire preassembled, this subassembly can then be positioned over shroud 100 with electrostatic discharge conductors 170 being received in channels 168.

While the invention has been disclosed with respect to a vertical board mount connector, the invention is not limited thereto. The invention could be used on other connectors, such as right angle board mount connectors and cable connectors.

We claim:

1. A plug type multiple contact electrical connector comprising:

a body portion formed from an insulative material, said body portion having a base and at least one outwardly projecting blade member extending from said base and terminating in a leading edge;

a plurality of electrical contacts mounted to each of said at least one projecting blade members;

an outer housing formed from an electrically conductive material and attached to said insulative body portion, said conductive outer housing at least partially surrounding said at least one projecting blade member;

a conductive material mounted on the leading edge of at least one of said projecting blade members, said conductive material extending along the surface of said insulative body portion and terminating at an electrical connection with said conductive outer housing.

2. A plug type electrical connector comprising:

a block of insulative material, said block of insulative material including a widened base section and a narrower section integrally formed with and extending from said widened base section, said narrower section of said block of insulative material having a top side, a bottom side and a leading edge;

at least one electrical contact mounted to each of said top and bottom sides of said narrower section of said block of insulative material;

a conductive outer shell attached to said widened base section of said block of insulative material, said conductive outer shell at least partially surrounding said narrower section of said block of insulative material; and an electrical conductor mounted to said narrower section of said block of insulative material, said electrical conductor positioned forward of said top and bottom side mounted electrical contacts relative to said leading edge such that electrostatic voltage potentials are discharged to said electrical conductor;

wherein said narrower section of said block of insulative material further comprises sidewalls, said electrical conductor mounted on said leading edge of said insulative block extending along said sidewalls and the surface of said widened base section, said electrical conductor terminating at said conductive outer housing.

3. An electrical connector as set forth in claim 2 wherein said leading edge of block of insulative material is grooved and said electrical conductor is mounted in said groove.

4. A plug type multiple contact electrical connector comprising:

a body portion formed from an insulative material, said body portion having a base and at least one outwardly projecting blade member extending from said base and terminating in a leading edge;

a plurality of electrical contacts mounted to each of said at least one projecting blade members;

an outer housing formed from an electrically conductive material and attached to said insulative body portion, said conductive outer housing at least partially surrounding said at least one projecting blade member;

a conductive material mounted on at least one of said projecting blade members, said conductive material extending along the surface of said insulative body portion and terminating at an electrical connection with said conductive outer housing.

5. A plug type electrical connector as set forth in claim 4 wherein each of said at least one projecting blade members further include sidewalls and wherein said conductive material mounted on the leading edges of each of said at least one projecting blade members extend along said sidewalls of said projecting blade member and the surface of said insulative body portion, said conductive material terminating at said conductive outer housing.

6. A plug type electrical connector as set forth in claim 5 wherein each of said electrical contacts further comprises an electrical contact for providing a first electrical connection and a pin connector for providing a second electrical connection.

7. A plug type electrical connector as set forth in claim 6 wherein said leading edge of each of said projecting blade members is grooved and wherein said conductive material further comprises a conductive wire insertably mounted into each of said grooves.

8. A plug type electrical connector as set forth in claim 7 wherein said at least one projecting blade member further comprises first, second and third projecting blades.

9. A plug type electrical connector as set forth in claim 8 wherein said projecting blades further include top and bottom sides and wherein electrical contacts are mounted on both said top and bottom sides of each of said projecting blades.

10. A plug type electrical connector as set forth in claim 9 wherein said top and bottom sides of each of said projecting blades are slotted and wherein said electrical contacts are insertably mounted in said slots.

11. An electrical connector with attached electrostatic discharge wires, comprising: a dielectric housing with a mating side, electrically conductive contacts supported by the housing, planar distal edges of the housing extending from the mating side, multiple electrostatic discharge wires aligned coplanar with respective planar distal edges, ends of each of the wires extending along the mating side while being coplanar with one of the distal edges, in each said distal edge a slot aligned with and receiving one of the wires therein, said slot extending from said distal edge and extending to channels along the mating side in alignment with the ends of one said one wire, a conductive shell encircling the planar distal edges, a conductive flange on the shell engaging and biasing the ends of the wires toward the channels, and the mating side and the flange being attached together and providing a clamp attachment of the ends of the wires between the mating side and the flange.

12. An electrical connector as recited in claim 11, and further comprising: the distal edges are on fins, the fins project from a base adjacent to the mating side, and each said slot extends along the base and then to said channels.

13. An electrical connector with attached electrostatic discharge wires, comprising: a dielectric housing with a mating side, electrically conductive contacts supported by the housing, planar distal edges of the housing extending from the mating side, electrostatic discharge wires aligned coplanar with respective planar distal edges, ends of each of the wires extending along the mating side while being coplanar with one of the distal edges, in each said distal edge a slot aligned with and receiving one of the wires therein, said slot extending from said distal edge and to the mating side, a conductive shell encircling the planar distal edges, a conductive flange on the shell engaging and biasing the ends of the wires toward the mating side, and the mating side and the flange being attached together and providing a clamp attachment of the ends of the wires between the mating side and the flange.

14. An electrical connector as recited in claim 13, and further comprising: the distal edges are on fins projecting from the mating face, the fins project from a base adjacent to the mating side, and each said slot extends along the base and then to said channels.

15. An electrical connector with attached electrostatic discharge wires, comprising: a dielectric housing with a mating side, electrically conductive contacts supported by the housing, planar distal edges of the housing extending from the mating side, electrostatic discharge wires aligned coplanar with respective planar distal edges, ends of each of the wires extending along the mating side while being coplanar with one of the distal edges, in each said distal edge a slot aligned with and receiving one of the wires therein, said slot extending from said distal edge and to the mating side, a conductive shell encircling the planar distal edges, a conductive flange on the shell engaging and biasing the ends of the wires toward the mating side, and the mating side and the flange being attached together and providing a clamp attachment of the ends of the wires between the mating side and the flange.

16. An electrical connector as recited in claim 15, and further comprising: the distal edges are on fins projecting from the mating face, the fins project from a base adjacent to the mating side, and each said slot extends along the base and then to channels in the mating side aligned with the ends of said wire.

17. An electrical connector as recited in claim 15, and further comprising: the ends of said wire are welded to the flange.

* * * * *